US006522026B2

(12) United States Patent
Bender et al.

(10) Patent No.: US 6,522,026 B2
(45) Date of Patent: Feb. 18, 2003

(54) DEVICE FOR ACTUATING ELECTRIC FUNCTIONAL ELEMENTS

(75) Inventors: Jürgen Bender, Frankfurt (DE); Martin Paul, Freisen (DE)

(73) Assignee: Takata-Petri AG, Aschaffenburg (DE)

( * ) Notice: Subject to any disclaimer, the term of this patent is extended or adjusted under 35 U.S.C. 154(b) by 0 days.

(21) Appl. No.: 10/045,656

(22) Filed: Jan. 15, 2002

(65) Prior Publication Data

US 2002/0109405 A1 Aug. 15, 2002

Related U.S. Application Data

(63) Continuation of application No. PCT/DE00/02389, filed on Jul. 17, 2000.

(30) Foreign Application Priority Data

Jul. 15, 1999 (DE) ..... 199 34 077

(51) Int. Cl.[7] ..... B60R 16/02
(52) U.S. Cl. ..... 307/10.1; 307/10.1; 307/38
(58) Field of Search ..... 307/9.1, 10.1, 307/36, 37, 38, 39, 40; 340/407.1; 200/236, 340, 330, 308, 303, 312, 314, 331

(56) References Cited

U.S. PATENT DOCUMENTS 3,629,608 A 12/1971 Trindle ..... 307/140
3,961,317 A 6/1976 De Brem et al.
4,095,123 A * 6/1978 Takahashi ..... 200/5 C
4,801,812 A 1/1989 Brusasco ..... 307/10 R

FOREIGN PATENT DOCUMENTS

DE 42 40 403 C1 3/1994
DE 43 26 663 C1 6/1994
FR 2 184 149 11/1973

OTHER PUBLICATIONS

Seisakusho et al: *Patent Abstract of Japan*; 60–194697; Oct. 3, 1985; Feb. 15, 1986, vol. 10, No. 39, 1 page.

* cited by examiner

*Primary Examiner*—Fritz Fleming
*Assistant Examiner*—Calixto Rodriquez
(74) *Attorney, Agent, or Firm*—Foley & Lardner

(57) ABSTRACT

A system for actuating electric functional elements comprising at least two physically separated actuating modules is provided. A defined electric function may be selectively triggered by any of the actuating modules. Each actuating module may have an electric actuating element for triggering the electric function and both actuating elements for triggering the electric function are connected parallel to each other. One electric subassembly may be connected in parallel to both actuating elements, whereby the subassembly is used to produce a characteristic electric code for the electric function which is to be triggered. A line controlled sensor circuit can thus be produced without any sensor prioritization.

15 Claims, 2 Drawing Sheets

DEVICE FOR ACTUATING ELECTRIC FUNCTIONAL ELEMENTS

CROSS REFERENCE TO RELATED APPLICATIONS

This is a continuation of International Application PCT/DE 00/02389, which has an international filing date of Jul. 17, 2000 and was published as WO 01/05628 (incorporated by reference herein in its entirety).

BACKGROUND

The invention relates to a device including a circuit for actuating electric functional elements having at least two physically separate actuating modules.

Such a device can be used to trigger electric functions selectively from one or the other actuating module and hence from different locations. Each actuating module has actuating elements for triggering the electric functions, with those actuating elements of different actuating modules which are provided for triggering the same electric function being connected in parallel with one another.

Such devices are used in motor vehicles, for example, so that particular electric devices in a motor vehicle, such as a car radio or a window lifter, can be operated both by the driver and by the passenger. Two physically separate actuating modules are provided for triggering the electric functions. One actuating module is positioned within reach of the driver and the other is positioned within reach of the passenger.

Problems arise with such circuits if the electric actuating modules are each provided for triggering a plurality of electric functions and accordingly have a plurality of actuating elements, each of which is associated with a particular electric function. Precautions are required to deal with the situation when different electric functions which are not meant to be performed simultaneously are triggered simultaneously as a result of incorrect operation of the actuating elements. Such a situation arises, for example, if the driver of a motor vehicle activates a particular electric system while the passenger simultaneously triggers an actuating element used to deactivate the system.

This problem is frequently solved in known electric circuits by giving priority to one of the actuating elements in the event of different actuating elements being operated simultaneously. The electric circuit is designed so that, when a plurality of actuating elements are operated simultaneously, only that electric function which is associated with the actuating element having the highest priority is triggered. However, such circuits have the drawback that, to prevent contradictory control commands which may result from incorrect actuation, some of the information contained in the electric signals triggered by the incorrect actuation is suppressed. This is because only the signals which have been triggered by actuation of the actuating element having the highest priority are processed. All other signals are masked out or suppressed.

In other circuit arrangements, the "prioritization" described previously is avoided by allocating each actuating element a dedicated signal line. In such a case, an appropriate control unit can evaluate the signals coming from the individual signal lines individually and can trigger the appropriate electric functions on the basis of this evaluation. However, these known devices have the drawback that they require a very high level of circuit complexity, particularly in cases in which each actuating module has a relatively large number of actuating elements associated with it.

Problems of the type described above may additionally arise if the actuating modules are incorporated in a circuit along with other manually triggerable electric units.

U.S. Pat. No. 4,801,812 (incorporated by reference herein) discloses an electric arrangement for actuating a window lifter on the passenger side of a motor vehicle, in which raising and lowering of the window can be selectively triggered both from an actuating device on the driver's side and from an actuating device on the passenger side; in which each of these two actuating devices has two switch positions for raising and lowering the window; and in which each of the two switch positions has an associated defined electric code which can be used to identify the respective electric function performed (raising or lowering of the window on the passenger side).

Accordingly, it is an object of the present invention to provide a device for actuating electric functions which uses simple means to permit extensive evaluation of the control commands produced by operation of the actuating elements in the different actuating modules.

SUMMARY OF THE INVENTION

According to the present invention a device for actuating electric functional elements having at least two physically separate actuating modules is provided. The device includes defined electric functions that may be selectively triggered from one or the other actuating module A1–$A_M$). Each of the actuating modules A1–$A_M$) has at least two electric actuating elements (1–N) for triggering different electric functions, and those actuating elements (1–N) of different actuating modules $A_1$–$A_M$) which are provided for triggering the same electric function are connected in parallel with one another, wherein the actuating elements (1 to N) provided for triggering the same electric function have a respective electric assembly ($B_1$–$B_N$) arranged in parallel with them which may be used to produce an electric code which is characteristic of the electric function to be triggered, wherein the electric actuating elements (1–N) within an actuating module $A_1$–$A_M$) are respectively connected in series with one another.

Accordingly, the electric actuating elements within an actuating module are respectively connected in series, the actuating elements associated with a particular electric function on different actuating modules having a respective electric assembly connected in parallel with them which has an electric code which is characteristic of the electric function.

The inventive solution has the advantage that, with the actuating elements in each module in a simple series circuit, evaluating the electric code makes it possible, at any time, to clearly establish which actuating elements have been actuated to trigger a particular electric function. This is because any actuation of an actuating element influences the electric code of the electric assembly arranged in parallel with the appropriate actuating element in a defined manner. Evaluating the code signals in a suitable evaluation unit thus allows the appropriate electric function to be performed either immediately or with a delay or else not at all, depending on the state of the system to be driven. Prioritization of the individual switching functions, which is always associated with information losses, is not necessary.

If a plurality of electric functions are triggered simultaneously in the inventive device (e.g. by different operators on different actuating modules), the evaluation unit records corresponding changes to the associated electric codes. The programming of the evaluation unit is then used to decide whether the individual electric functions are being performed simultaneously, in succession or only in part.

In this context, the different electric functions which may be controlled by the individual actuating elements of the actuating modules may be both associated with various electric functional elements and may affect different functions of one and the same functional element, such as in the case of two actuating elements for changing the volume of a car radio to a higher or lower volume.

In this context, a suitable electric code may easily be produced by virtue of the electric assembly being one or more passive electric components having an electric value which is characteristic of the respective electric function. Thus, the electric assembly may be formed by a nonreactive resistor whose resistance value is characteristic of the electric function to be triggered. By way of example, a resistor having a resistance value of 10 ohms is used for a first electric function, a resistor having a resistance value of 100 ohms is used for a second electric function, a resistor having a resistance value of 1000 ohms is used for a third electric function etc.

Instead of a simple nonreactive resistor, a complex resistor or a frequency-dependent resistor (e.g., an inductor or a capacitor), and also a voltage-dependent or current-dependent resistor, a diode circuit, in particular a zener diode circuit, or else a voltage reference circuit are suitable as alternatives. In addition, the electric components may also be combined with one another to form an appropriate electric assembly.

Alternatively, the electric assembly for producing a characteristic electric code may be an active electric circuit, for example a circuit for producing a characteristic pulse train and/or a characteristic frequency. Naturally, a frequency mix or characteristic amplitude modulation are also suitable in this regard.

In one preferred embodiment of the invention, all the actuating modules with their electric actuating elements and the associated electric assemblies are incorporated into an integrated electric circuit supplied with current via two external electric connections. This produces a particularly simple circuit design for the device.

The electric assemblies used for assigning the individual actuating elements to particular electric functions are preferably arranged in the actuating modules themselves. In this context, the connection of the electric assemblies in parallel with the appropriate electric actuating elements means that only one corresponding electric assembly is required per electric function to be controlled. The electric assembly is accordingly arranged in one of the actuating modules from which the appropriate electric function may be triggered using an actuating element.

In this case, the electric assemblies are preferably distributed over the actuating modules such that an electric current may flow through the device meanderingly when the electric actuating elements are fully off, the current passing through all of the electric assemblies, and, in this context, each leg of the meandrous current path running through all the (parallel-connected) actuating modules. Such a circuit arrangement may be produced, for example, by alternately assigning each of the electric assemblies used for producing a characteristic electric code to one of the actuating modules whose actuating elements form an outer edge of the parallel circuit.

This embodiment of the invention allows simple monitoring of the lines of the circuit arrangement and, in particular, reliable detection of line breakage or plug contact interruption when the electric actuating elements are fully off. This is because, when the actuating elements are fully off, the current may flow through the electric assemblies connected in parallel therewith and may thus meander through the entire circuit arrangement.

In this context, the two external electric connections form the two end points of the meandrous current path, for which purpose the two connections are connected to a respective actuating element which is at a maximum distance (in relation to the flow of current) from the connections of the associated, parallel-connected electric assembly.

The electric actuating elements may be formed both by electric switches and by pushbutton switches or other suitable switching elements.

The inventive device may be used, in particular, in motor vehicles, one of the actuating modules being able to be arranged in the steering wheel of the vehicle in order to allow the driver to reach it easily.

It is to be understood that both the foregoing general description and the following detailed description are exemplary and explanatory only, and are not restrictive of the invention as claimed.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

DETAILED DESCRIPTION

Figure 1:
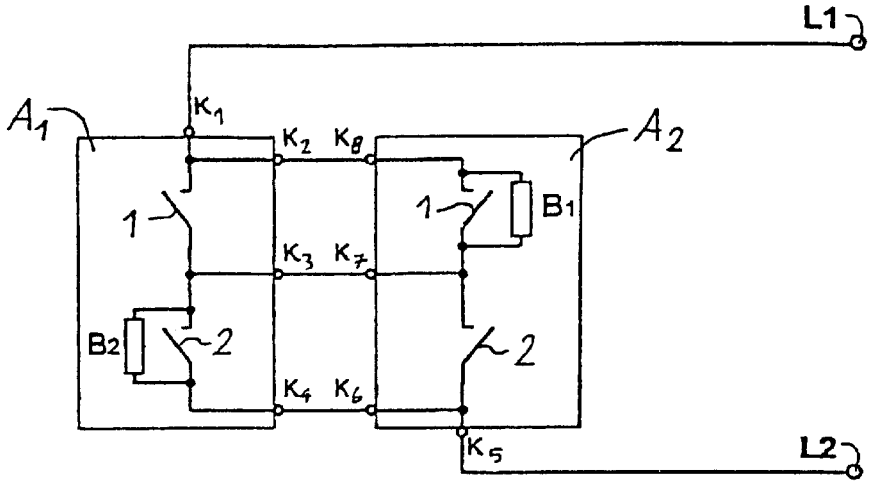
FIG. 1 is a circuit diagram of a circuit according to the present invention, the circuit having two actuating modules which each have two actuating elements for triggering two different electric functions.

FIG. 1 shows a circuit arrangement for actuating electric functions which have two actuating modules $A_1$ and $A_2$ arranged at a physical distance from one another. In this case, the actuating modules $A_1$, $A_2$ are in the form of touch sensor modules which are connected in parallel by means of terminals $K_2$–$K_4$ and $K_6$–$K_8$ and in which in each case two actuating or switching elements in the form of pushbutton switches 1, 2 are connected one after the other (in series). Each of the two pushbutton switches in one of the actuating modules $A_1$, $A_2$ is used to trigger a particular electric function, for example to control a radio, a window lifter or other electric functional elements in a motor vehicle.

Connected in parallel with each pushbutton switch 1, 2 of the actuating modules, $A_2$ is a respective corresponding pushbutton switch 1, 2 of the other actuating module $A_2$ or $A_1$. The two parallel-connected pushbutton switches are each used to trigger the same electric function. The circuit arrangement shown in FIG. 1 thus makes it possible to trigger two electric functions firstly by actuating the two pushbutton switches 1, 2 of the first actuating module $A_1$ and, alternatively, by actuating the pushbutton switches 1, 2 of the second actuating module $A_2$. Since the two actuating modules $A_1$, $A_2$ are arranged at a physical distance from one another, this circuit arrangement allows the two electric functions mentioned to be actuated from two different locations. In a motor vehicle, for example, the first actuating module $A_1$ may be arranged within the grasp of the driver and the second actuating module $A_2$ may be arranged within the grasp of the passenger, so that either of the two may trigger the appropriate electric functions.

In accordance with the invention, each of the two electric functions which may be controlled using the circuit arrangement shown in FIG. 1 now has an associated electric assembly $B_1$ and $B_2$, respectively, which is provided for producing an electric code which is characteristic of the respective electric function. The two electric assemblies $B_1$ and $B_2$ are arranged in parallel with the associated pushbutton switches 1 and 2 which may be used to trigger the appropriate electric function. In this case, one of the electric assemblies $B_1$, $B_2$ is associated with the first actuating module $A_1$ and the other is associated with the second actuating module $A_2$, specifically such that the connections of the appropriate electric assembly $B_1$ or $B_2$ are respectively situated on both sides of the associated pushbutton switch 1 or 2 in the respective actuating module $A_2$ or $A_1$.

Actuating one of the pushbutton switches 1 or 2 in one of the actuating modules $B_1$ or $B_2$ results in the associated electric assembly $B_1$ or $B_2$ being shorted. This measurably influences the electric code produced by the appropriate electric assembly $B_1$ or $B_2$.

Suitable electric assemblies may be selected from a multiplicity of electric circuits which may be used to produce a characteristic electric code. In the present case, for the sake of simplicity, it may be assumed that the electric assemblies $B_1$ and $B_2$ are two nonreactive resistors having different resistance values.

It is obvious that the nonreactive resistance of the entire circuit arrangement is characteristically changed when one of the pushbutton switches 1, 2 is actuated to trigger a particular electric function. Another characteristic change in the nonreactive resistance of the circuit arrangement when two pushbutton switches 1, 2 used for triggering different electric functions are actuated simultaneously.

The entire circuit arrangement may connected to a suitable voltage source by means of two external electric connections L1, L2. In this case, the first external connection L1 is connected to the first actuating module $A_1$ and the second external connection L2 is connected to the second actuating module $A_2$, specifically such that the two connections L1, L2 are respectively associated with a pushbutton switch 1 or 2 which is at a maximum distance from the associated electric assembly $B_1$ or $B_2$. The external connections L1 are connected to those pushbutton switches 1, 2 of the actuating modules $A_1$. $A_2$ which do not have an electric assembly $B_1$, $B_2$ directly associated with them.

On the basis of the described arrangement of the electric assemblies $B_1$, $B_2$ and of the external connections L1, L2 in the circuit arrangement shown in FIG. 1, a current may flow through the entire circuit arrangement when the pushbutton switches 1, 2 are fully off. For an assumed flow of current from the first connection L1 to the second connection L2, the current would flow via the external connection point K1 of the first actuating module $A_1$, via the connection terminals $K_2$ and $K_8$, the first electric assembly $B_1$, the connection terminals $K_7$ and $K_3$, the second electric assembly $B_2$, the connection terminals $K_4$ and $K_6$ and also the external connection point $K_5$ of the second actuating module $A_2$ to the second external connection L2.

The electric current flows meanderingly from the first external connection L1 to the second external connection L2, the three connecting lines which run via the terminals $K_2$, $K_8$; $K_3$, $K_7$ and $K_4$, $K_6$ between the parallel-connected actuating modules $A_1$, $A_2$ forming the legs of the meandrous current path, and each of these legs of the meandrous current path running through the two actuating modules $A_1$ and $A_2$. This flow of current when the pushbutton switches 1, 2 are fully off is made possible because the current may flow through the electric assemblies $B_1$ and $B_2$ arranged in parallel with these pushbutton switches.

When the pushbutton switches 1, 2 are fully off, the circuit arrangement shown in FIG. 1 readily allows diagnosis of the line functions of the entire arrangement for possible line interruptions or detached plug connections at one of the terminals $K_1$ to $K_8$. The signals produced by actuating the pushbutton switches 1, 2 to trigger defined electric functions may be evaluated, and the circuit may be checked for correct line functions, by a normal electronic evaluation unit which is connected to the circuit arrangement shown in FIG. 1.

Figure 2:
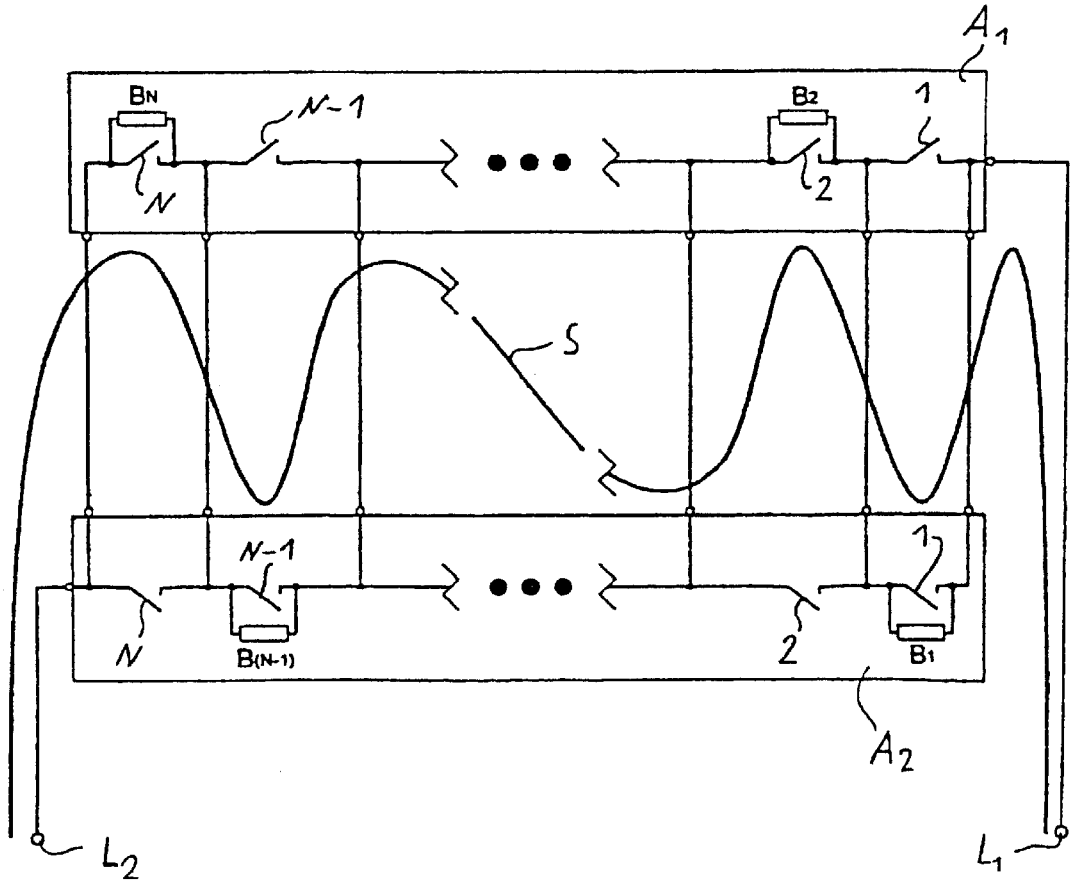
FIG. 2 is a circuit diagram of a circuit according to the present invention, the circuit having two actuating modules which each have N actuating elements for triggering N different electric functions.

FIG. 2 shows a generalization of the exemplary embodiment from FIG. 1 to two actuating modules $A_1$, $A_2$ which each have any desired number of series-connected pushbutton switches 1, 2, . . . , N−1, N, with the pushbutton switches provided for triggering the same electric function being respectively connected in parallel with one another in the two actuating modules $A_1$, $A_2$, and an electric assembly $B_1$, $B_2$, . . . , $B_{N-1}$, $B_N$ additionally being respectively arranged in parallel with these pushbutton switches, which electric assembly may be used to produce an electric code which is characteristic of the respective electric function to be triggered.

FIG. 2 reveals that the electric assemblies $B_1$ to $B_N$ are each alternately associated with the two actuating modules $A_1$ and $A_2$, which means that, in this case as in the exemplary embodiment from FIG. 1, the current may meander from the first external connection L2 through the entire circuit arrangement to the second external connection L2 when the pushbutton switches 1 to N are fully off. The meandrous current profile is schematically shown in FIG. 2 by the line S in this case.

As in the case of the exemplary embodiment shown in FIG. 1, the first external connection L1 is connected to the first touch sensor module $A_1$, and the second external connection L2 is connected to the second touch sensor module $A_2$ in this case too. This kind of arrangement of the external connections L1, L2 is produced by virtue of the external connections L1, L2 being respectively assigned to a pushbutton switch 1 or N which is at a maximum distance from the associated electric assembly $B_1$ or $B_N$. This means that, when there is an even number of series-connected pushbutton switches 1 to N, the two external connections L1 and L2 are respectively associated with different actuating modules $A_1$ and $A_2$. (Accordingly it is thus assumed in FIG. 2 that N is an even number.) By contrast, with an uneven number of pushbutton switches (and accordingly an uneven number of controllable electric functions), the two external connections L1 and L2 are respectively associated with the same actuating module.

Figure 3:
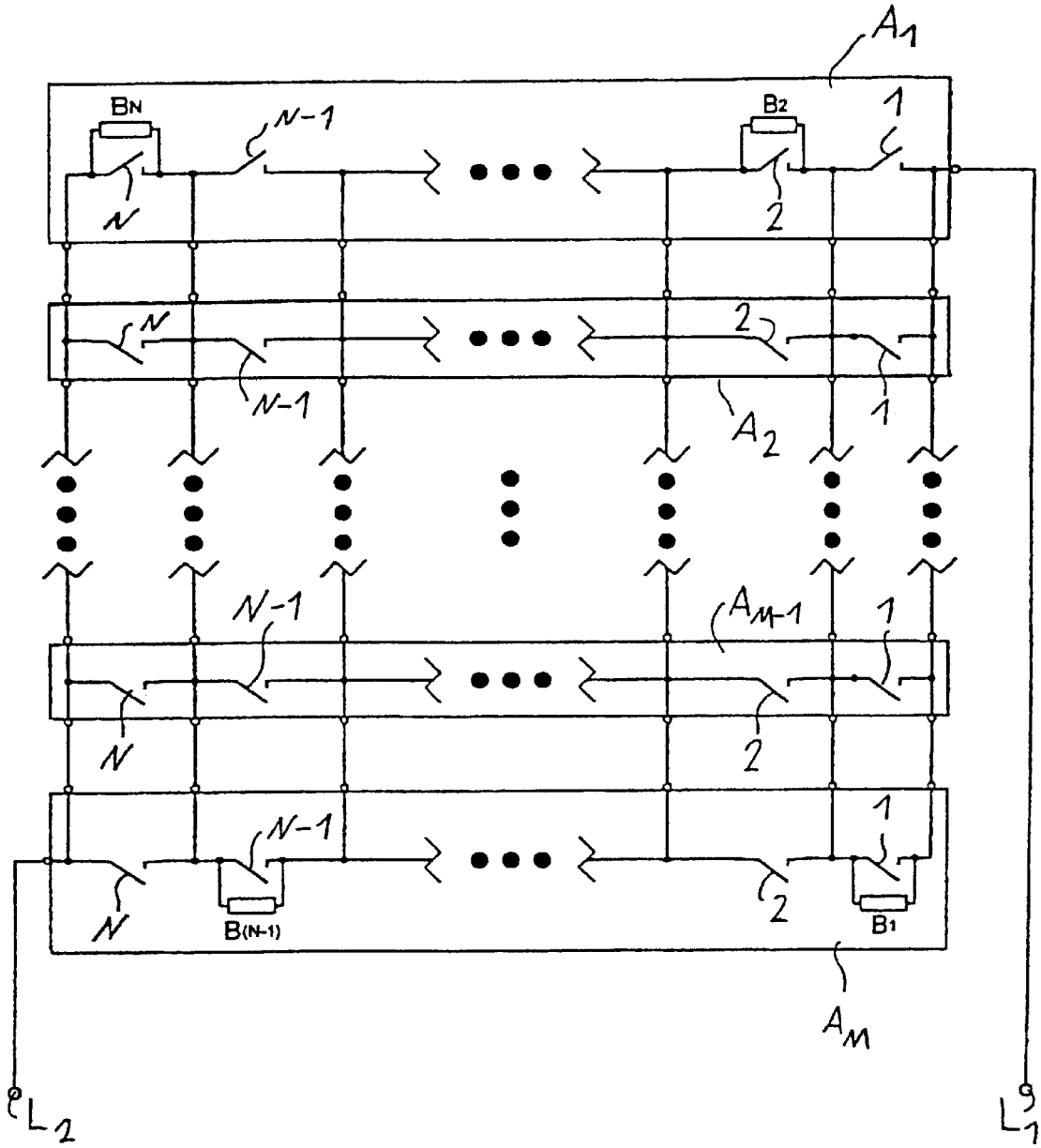
FIG. 3 is a circuit diagram of a circuit according to the present invention, the circuit having M actuating modules which each have N actuating elements for triggering N different electric functions.

FIG. 3 shows another generalization of the exemplary embodiment from FIG. 2, in which an arbitrary number of parallel-connected actuating modules $A_1$, $A_2$, . . . , $A_{M-1}$, . . . , $A_M$ having a respective arbitrary number of pushbutton switches 1, 2, . . . , N−1, N is provided. In this case, the pushbutton switches of all actuating modules used for triggering the same electric function are respectively connected in parallel. The appropriate function is identified using an electric assembly which is again arranged in parallel with these pushbutton switches and is provided for producing a characteristic electric code.

FIG. 3 reveals that the electric assemblies $B_1$ to $B_N$ are alternately respectively associated with the two actuating modules $A_1$ and $A_M$ forming the outer edge of the circuit arrangement comprising a plurality of parallel-connected actuating modules. This arrangement of the electric assemblies $B_1$ to $B_N$ and a suitable arrangement of the external connection terminals L1, L2 means that, in this case, too, a current may flow meanderingly from the first external connection L1 through the entire circuit arrangement to the second external connection L2 when the pushbutton switches 1 to N are fully off. In this case, the two external connections L1, L2 form the ends of the meandrous current path.

Given the disclosure of the present invention, one versed in the art would appreciate that there may be other embodiments and modifications within the scope and spirit of the invention. For example, all the circuits described above may also be produced using switches instead of pushbutton switches as actuating elements. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A device for actuating electric functional elements comprising:

at least two physically separate actuating modules wherein defined electric functions are selectively triggered from the actuating modules;

wherein each of the actuating modules has at least two electric actuating elements for triggering different electric functions, the actuating elements of different actuating modules that are provided for triggering the same electric function are connected in parallel with one another, wherein the actuating elements provided for triggering the same electric function have a respective electric assembly arranged in parallel, the electric assembly being able to produce an electric code characteristic of the electric function to be triggered, wherein the electric actuating elements within an actuating module are connected in series.

2. The device of claim 1, wherein all the actuating modules with their actuating elements are incorporated into an integrated circuit having two external electric connections.

3. The device of claim 2, wherein the electric assemblies producing a characteristic code for the respective electric function are distributed over the actuating modules such that an electric current flows through the device meanderingly when the electric actuating elements are fully off, the current flowing through all the electric assemblies and through all the actuating modules.

4. The device of claim 3, wherein the two external electric connections form the end points of a path for the meandrous current.

5. The device of claim 4, wherein the two external electric connections are connected to a respective actuating element which is at a maximum distance from the associated, parallel-connected electric assembly.

6. The device of claim 1, wherein two of the at least two actuating modules form the edges of a parallel electric circuit containing the electric assemblies for producing a characteristic electric code, and wherein the electric assemblies are each alternately associated with one of the two actuating modules forming the edge of the parallel circuit.

7. The device of claim 1, wherein the electric actuating elements are formed by pushbutton switches.

8. The device of claim 1, wherein the electric actuating elements are formed by switches.

9. The device of claim 1, wherein the electric assembly is formed by at least one passive electric component having a characteristic electric value.

10. The device of claim 9, wherein the electric assembly is one of the following components: a resistor, an inductor, a capacitor, a diode circuit or a combination of such components.

11. The device of claim 1, wherein the electric assembly is formed by an active electric circuit.

12. The device of claim 11, wherein the electric circuit is designed to produce a characteristic pulse train and/or a characteristic frequency.

13. The device of claim 1, further comprising an evaluation unit for evaluating the electric signals triggered when the actuating elements are actuated.

14. The device of claim 1, wherein the device is used for triggering electric functional elements in a motor vehicle.

15. The device of claim 14, wherein the device is at least partially incorporated into a steering wheel.

* * * * *